US006608431B1

(12) United States Patent
Kaufman

(10) Patent No.: US 6,608,431 B1
(45) Date of Patent: Aug. 19, 2003

(54) MODULAR GRIDLESS ION SOURCE

(75) Inventor: Harold R. Kaufman, LaPorte, CO (US)

(73) Assignee: Kaufman & Robinson, Inc., Ft. Collins, CO (US)

( * ) Notice: Subject to any disclaimer, the term of this patent is extended or adjusted under 35 U.S.C. 154(b) by 0 days.

(21) Appl. No.: 10/154,753

(22) Filed: May 24, 2002

(51) Int. Cl.[7] ..... F03H 5/00

(52) U.S. Cl. ..... 313/231.31; 313/359.1; 315/111.41

(58) Field of Search ..... 313/231.31, 161, 313/230, 359.1, 231.61, 111.9; 315/111.41, 111.61, 111.81; 250/427; 60/202; F03H 5/00

(56) References Cited

U.S. PATENT DOCUMENTS 4,446,403 A 5/1984 Cuomo et al.
4,862,032 A 8/1989 Kaufman et al.
5,616,179 A * 4/1997 Baldwin et al. ..... 117/108
5,973,447 A * 10/1999 Mahoney et al. ..... 313/359.1

OTHER PUBLICATIONS

"Physics of closed drift thrusters", Plasma Sources Sci.Tech.8 (1999), R1–R20.

"Ion Source Design for Industrial Aplications", vol. 20, No. 6, AIAA Journal (Jun., 1982), pp. 745–760.

Ion Beam Neutralization, CSC Technical Note.

Characteristics, Capabilities, and Applications of Broad-Beam Sources, Kaufman et al., 1987.

* cited by examiner

*Primary Examiner*—Hoanganh Le
(74) *Attorney, Agent, or Firm*—Dean P. Edmundson

(57) ABSTRACT

In accordance with one embodiment of the present invention, the ion-beam apparatus takes the form of an end-Hall ion source in which the detachable anode module incorporates the outer pole piece and includes an enclosure around the anode that both minimizes the loss of working gas and confines sputter contamination to the interior of this enclosure. This detachable anode module is substantially smaller than the entire end-Hall ion source, weighs substantially less, and can be duplicated for significantly less cost than the duplication of the entire ion source. In general, the components of the magnetic circuit determine the overall size, weight, and much of the cost of a gridless ion source. The reduced size, weight, and cost of the detachable anode module compared to the entire ion source is due to most of the magnetic circuit being excluded from the detachable module.

24 Claims, 9 Drawing Sheets

MODULAR GRIDLESS ION SOURCE

FIELD OF INVENTION

This invention relates generally to ion and plasma sources, and more particularly it pertains to gridless or Hall-current ion sources.

BACKGROUND ART

Industrial ion sources are used for etching, deposition and property modification, as described by Kaufman, et al., in the *Characteristics, Capabilities*, and *Applications of Broad-Beam Sources*, Commonwealth Scientific Corporation, Alexandria, Va. (1987).

Both gridded and gridless ion sources are used in these industrial applications. The ions generated in gridded ion sources are accelerated electrostatically by the electric field between the grids. Only ions are present in the region between the grids and the magnitude of the ion current accelerated is limited by space-charge effects in this region. Gridded ion sources are described in an article by Kaufman, et al., in the *AIAA Journal*, Vol. 20 (1982), beginning on page 745. The particular sources described in this article use a direct-current discharge to generate ions. It is also possible to use electrostatic ion acceleration with a radio-frequency discharge.

In gridless ion sources the ions are accelerated by the electric field generated by an electron current interacting with a substantial magnetic field in the discharge region. The overall size and weight of a gridless source is primarily determined by the magnetic circuit to generate this magnetic field. A substantial fraction of the overall cost of a gridless ion source is also associated with the magnetic circuit. In contrast, when a magnetic field is used in a gridded ion source, it is only to contain the 50 eV, or less ionizing electrons. The magnetic circuit in a gridded ion source thus plays a secondary role to the ion optics in determining ion-source size and cost.

Because the ion acceleration takes place in a quasineutral plasma, there is no space-charge limitation on the ion current that can be accelerated in a gridless ion source. The lack of a space-charge limitation is most important at low ion energies, where a gridded ion source is severely limited in ion-current capacity.

The closed-drift ion source is one type of gridless ion source and is described by Zhurin, et al., in an article in *Plasma Sources Science & Technology*, Vol. 8, beginning on page R1, while the end-Hall ion source is another type of gridless ion source and is described in U.S. Pat. No. 4,862,032—Kaufman, et al. These publications are incorporated herein by reference.

A Hall current of electrons is generated normal to both the applied magnetic field and the electric field generated therein, so that these ion sources have also been called Hall-current sources. Because the neutralized ion beams generated by these ion sources are also quasineutral plasmas, i.e., the electron density is approximately equal to the ion density, they have also been called plasma sources.

Gridless ion sources used in industrial applications need routine maintenance. This maintenance can result from the limited lifetimes of certain parts, such as cathodes. The need for maintenance can also result from the contamination of ion-source parts due to sputter deposition within the ion source, or from the contamination with materials present in the particular application in which the ion source is used.

The contamination can be in the form of conducting layers on insulators, insulating layers on conducting parts, or deposited films that can peel off to cause electrical shorts or flake off in smaller particles to generate unwanted particulates.

Performing the routine maintenance typically involves replacing cathodes and some other parts with limited lifetimes, cleaning the remaining metal parts, and replacing insulators. The ion sources must be substantially disassembled to carry out this maintenance.

The expense of performing maintenance on gridless ion sources is not limited to the direct time and materials involved. The downtime for the vacuum chamber and associated hardware often constitutes a major expense. This latter expense can be reduced by purchasing two ion sources, so that maintenance can be performed on one ion source while the other is being used. However, the purchase of an additional ion source is an additional expense that must be balanced against the reduction in downtime expense.

SUMMARY OF INVENTION

In light of the foregoing, it is a general object of the invention to provide a gridless ion source with a detachable anode module that facilitates rapid and economical maintenance.

A specific object of the invention is to provide a gridless ion source with a detachable anode module in which the cost of that module is substantially less than the expense of the entire ion source.

Another specific object of the invention is to provide a gridless ion source with a detachable anode module in which the size and weight of that module is substantially less than the size and weight of the entire ion source.

A further specific object of the invention is to provide a gridless ion source with a detachable anode module in which the contamination of ion-source parts due to sputter deposition within the ion source, and the associated maintenance, is essentially confined to that module.

Yet another specific object of the invention is to provide a gridless ion source with a detachable anode module in which the deposition on ion-source parts due to contamination sources external to the ion source are largely confined to that module.

Still another specific object of the invention is to provide a gridless ion source with a detachable anode module in which the loss of working gas is minimized by a gas enclosure surrounding the anode in that module.

In accordance with one embodiment of the present invention, the ion-beam apparatus takes the form of an end-Hall ion source in which the detachable anode module incorporates the outer pole piece and includes an enclosure around the anode that both minimizes the loss of working gas and confines sputter contamination to the interior of this enclosure. This detachable anode module is substantially smaller than the entire end-Hall ion source, weighs substantially less, and can be duplicated for significantly less cost than the duplication of the entire ion source. In general, the components of the magnetic circuit determine the overall size, weight, and much of the cost of a gridless ion source. The reduced size, weight, and cost of the detachable anode module compared to the entire ion source is due to most of the magnetic circuit being excluded from the detachable module.

DESCRIPTION OF FIGURES

Features of the present invention which are believed to be patentable are set forth with particularity in the appended claims. The organization and manner of operation of the invention, together with further objectives and advantages thereof, may be understood by reference to the following descriptions of specific embodiments thereof taken in connection with the accompanying drawings, in the several figures of which like reference numerals identify like elements and in which:

DESCRIPTION OF PRIOR ART

Figure 1:
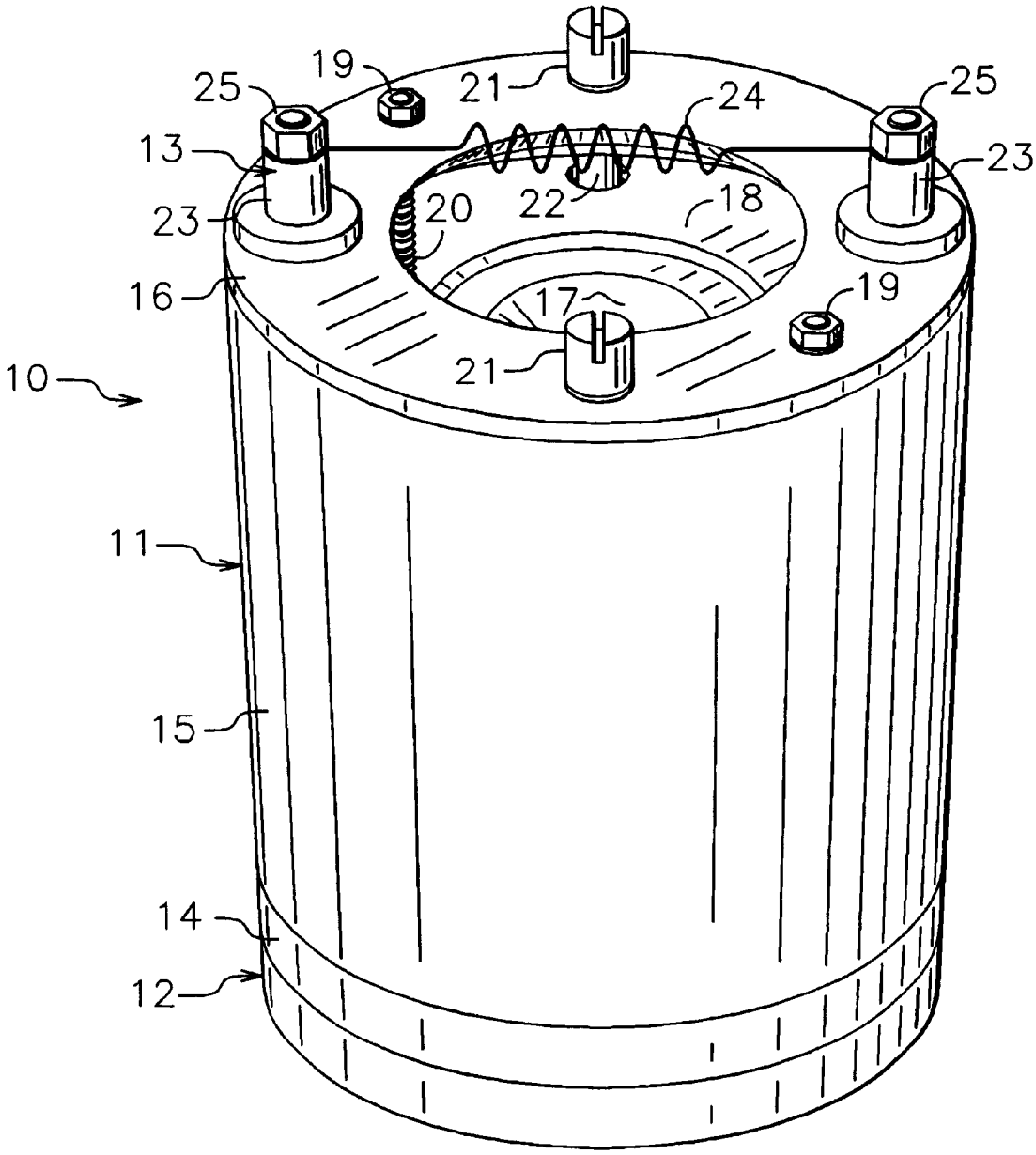
Fig. 1 (PRIOR ART)
FIG. 1 is a prior-art gridless ion source of the end-Hall type.

Referring to FIG. 1, there is shown a prior-art gridless ion source 10 of the end-Hall type. Ion source 10 is generally of the type described in U.S. Pat. No. 4,862,032—Kaufman, et al. More specifically, it is a Mark II ion source marketed first by Commonwealth Scientific Corporation, Alexandria, Va., and more recently by Veeco Instruments Inc., Plainview, N.Y. Differences of the Mark II ion source from the aforementioned U.S. Pat. No. 4,862,032 include the use of a plug-and-socket design to facilitate removal for maintenance and the use of a permanent magnet in place of the electromagnet to generate the magnetic field. The plug-and-socket concept is generally similar to that shown in the earlier U.S. Pat. No. 4,446,403—Cuomo, et al.

Ion source 10 includes ion-source assembly 11, socket assembly 12, and cathode assembly 13. The components of the ion-source assembly shown in FIG. 1 include plug body 14, outer shell 15, and outer pole piece 16, all of which are also parts of the magnetic circuit. Also included in ion-source assembly 11 and shown in FIG. 1 are anode 17, external anode support 18, retaining nuts 19 that must be removed to disassemble the ion-source assembly, threaded retainer rods 20 to which nuts 19 attach, and knobs 21 that attach to plug-and-socket retaining rods 22. When knobs 21 are tightened, ion-source assembly 11 is clamped to socket assembly 12, establishing both the electrical connections and the gas connection necessary for operation. Cathode assembly 13 includes cathode supports 23, cathode 24, and cathode retaining nuts 25. To separate the cathode assembly from the rest of the ion source, the two cathode supports are grasped with the fingers of two hands and lifted, overcoming the friction with which the cathode supports are attached to the rest of the ion source.

Figure 2:
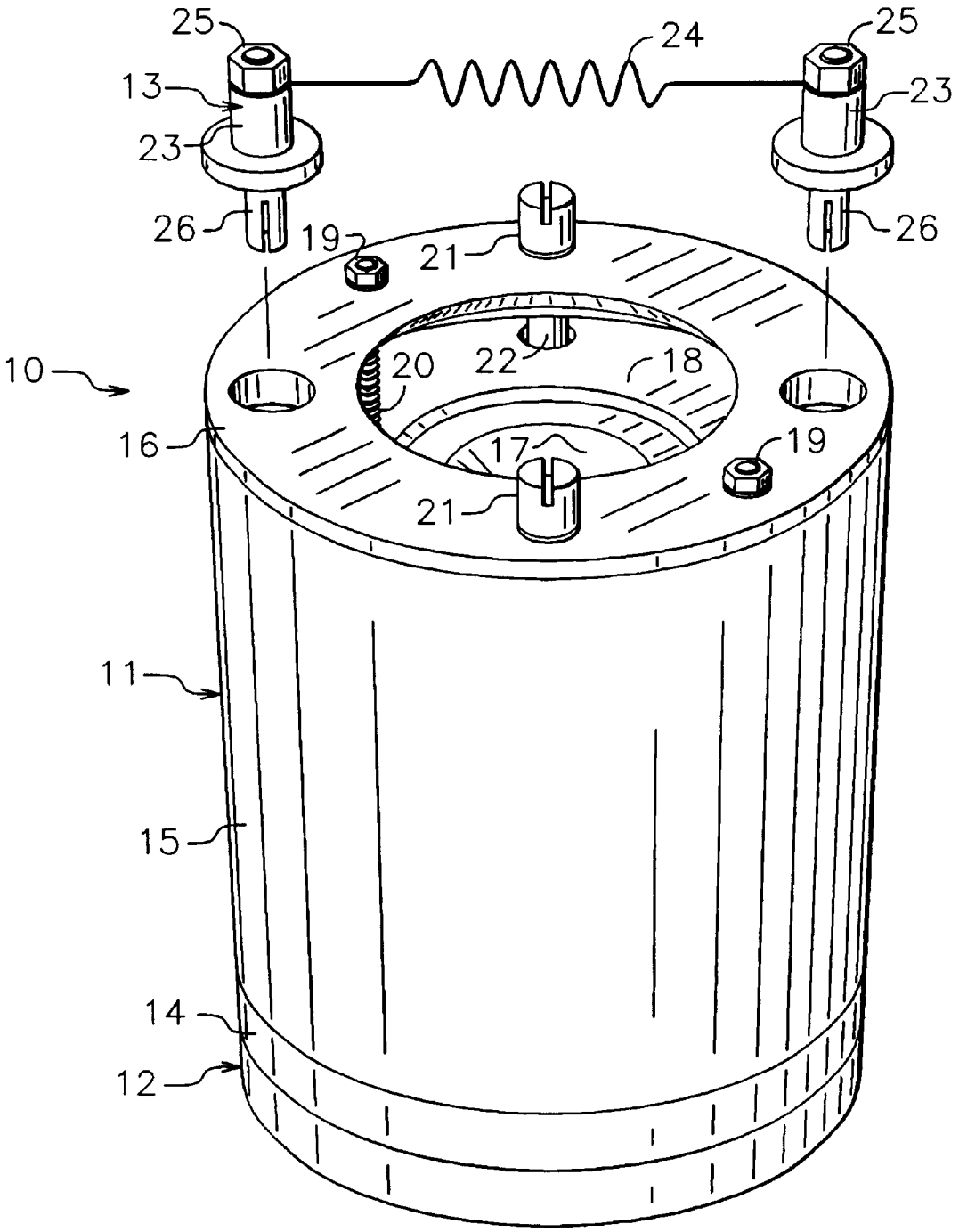
Fig. 2 (PRIOR ART)
FIG. 2 shows the prior-art ion source of FIG. 1 with the hot-filament cathode assembly separated from the rest of the ion source.

Referring to FIG. 2, ion source 10 is shown with cathode assembly 13 separated from the rest of the ion source. At the separated location, the lower ends of cathode supports 23 are exposed to show connectors 26 thereon, with each connector comprised of elastic spring "fingers" to establish an electrical connection with a complementary cylindrical contact. The spring fingers of the connectors also generate the friction that must be overcome in removing the cathode assembly from the ion-source assembly. Ion source assembly 11 can be separated from socket assembly 12 by rotating knobs 21, thereby removing the threaded ends of plug-and-socket retaining rods 22 from socket assembly 12.

It should be noted that the hot-filament cathode shown in FIGS. 1 and 2, together with its particular installation, is exemplar only. Different mounting arrangements are possible for hot-filament cathodes. Also, end-Hall ion sources have been operated with hot-filament, hollow-cathode, and plasma-bridge types of electron-emitting cathodes. These alternate cathodes are described in "Ion Beam Neutralization," anon., CSC Technical Note, Commonwealth Scientific Corporation, Alexandria, Va. (1991). This publication is also incorporated herein by reference.

Figure 3:
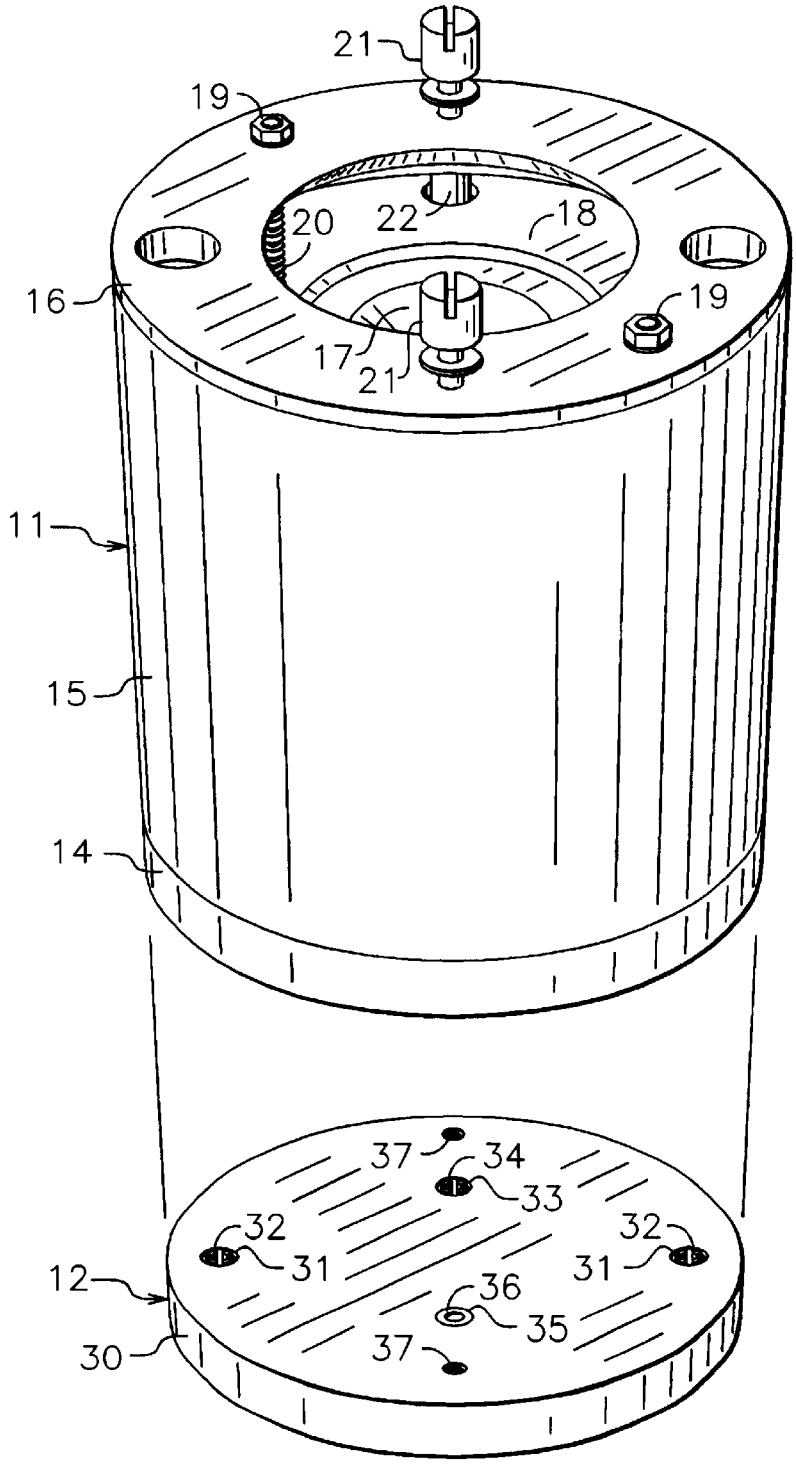
Fig. 3 (PRIOR ART)
FIG. 3 shows the prior-art ion source of FIGS. 1 and 2, without the hot-filament cathode assembly, but with the ion-source assembly separated from the socket assembly.

Referring to FIG. 3, ion-source assembly 11 is shown separated from socket assembly 12. The socket assembly is comprised of socket body 30, openings 31 with socket connectors 32 therein to provide the electrical connections for cathode 24, opening 33 with socket connector 34 to provide the electrical connection for anode 17, threaded opening 35 with threaded gas fitting 36 to provide a flow path for the ionizable working gas used in the ion source, and threaded openings 37 for the threaded lower ends of plug-and-socket retaining rods 22 to be threaded into and thereby clamp ion-source assembly 11 to socket assembly 12. The socket connectors in FIG. 3 are generally similar in function to connectors 26 shown at the lower ends of cathode supports 23.

Figure 4:
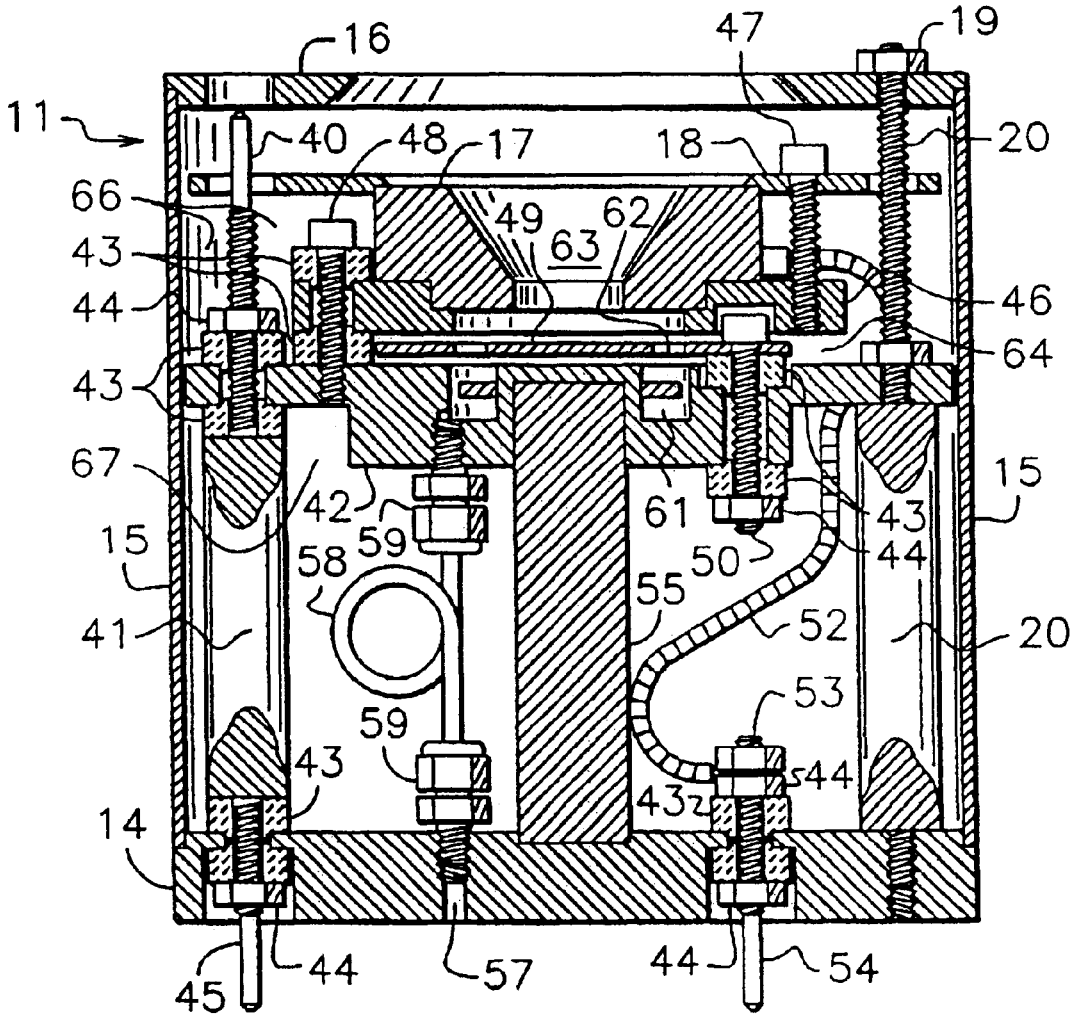
Fig. 4 (PRIOR ART)
FIG. 4 shows a cross section of the ion-source assembly of the ion source shown in FIGS. 1, 2, and 3.

Referring to FIG. 4, there is shown a cross section of ion-source assembly 11. Note that the cross section of FIG. 4 is not a particular cross section of the Mark II ion source, but instead is one that has been constructed to include the major design features of that ion source. That is, only one exemplar feature is shown when there are typically a plurality of such features. As an example, only one accommodation is shown for a cathode support, when two cathode supports are normally installed on opposite sides of the ion-source assembly, so that both would normally show in the same cross section through the center line. When the cathode assembly is installed on the ion-source assembly, sockets 26 of cathode assembly 13 (shown in FIG. 2) are electrically connected to cylindrical contacts 40, which are integral parts of cathode support rods 41. Cathode support rods 41 are spaced from and located relative to main support plate 42 and plug body 14 by ceramic insulators 43 held in place by nuts 44. The lower ends of cathode support rods 41 form contacts 45 which, when ion-source assembly 11 is clamped to socket assembly 12, provide electrical connections with complementary cathode connectors 32 shown in FIG. 3. It should be noted that to provide an insulative function at high temperature without adverse outgassing, insulators 43 are typically fabricated from a refractory ceramic material such as alumina.

Anode 17 is held between external anode support 18 and internal anode support 46, with the external and internal anode supports in turn held together with screws 47. The assembly of anode and internal and external anode supports is spaced from and located relative to main support plate 42 by additional ceramic insulators 43 held in place by screws 48. Reflector 49 is also spaced from and located relative to main support plate 42 by additional ceramic insulators 43 held in place by screws 50 and additional nuts 44.

Still referring to FIG. 4, the anode is connected by conducting wire covered with ceramic insulator beads 52 to anode rod 53 which is spaced from and located relative to plug body 14 by additional ceramic insulators 43 held in place by additional nuts 44. Contact 54 is an integral part of anode rod 53 and is electrically connected to complementary anode connector 34 in the socket assembly (FIG. 3) when the ion-source assembly is clamped to the socket assembly. Permanent magnet 55 magnetically energizes the magnetically permeable parts of the magnetic circuit, which include plug body 14, outer shell 15, and outer pole piece 16. Parts other than those of the magnetic circuit are constructed of essentially nonmagnetic materials, i.e., parts with a magnetic permeability not significantly different from free space. Main support plate 42 is spaced from and located relative to plug body 14 by threaded retainer rods 20.

The ionizable working gas is introduced through gas fitting 36 which is attached to a gas feed tube (not shown) and installed in threaded opening 35 (see FIG. 3). Returning to FIG. 4, when ion-source assembly 11 is clamped to socket assembly 12, the working gas flows from the socket assembly into volume 57, through first gas fitting 59, through tube 58, through second gas fitting 59, to circumferential manifold 61. From this manifold, the working gas flows though apertures 62 in reflector 49 to reach discharge volume 63, where collisions of energetic electrons emitted from cathode 24 (shown in FIGS. 1 and 2) ionize the working gas. The ions formed by these collisions in volume 63 are accelerated by electric fields in that volume to form an energetic ion beam. A more detailed description of the operation of an end-Hall ion source is included in the aforementioned U.S. Pat. No. 4,862,032—Kaufman, et al., which is included herein by reference. A schematic diagram showing the required power supplies to operate an end-Hall ion source is also included in the aforementioned patent.

Those skilled in the art of ion sources will recognize that, similar to other ion sources used in industrial applications, ion source 10 is installed in a vacuum chamber. The vacuum chamber is normally assumed to be ground in the ion-source circuit, and is usually also at earth ground.

The magnetic circuit is comprised of those parts that are used to generate a magnetic field between the anode and electron-emitting cathode, i.e., the magnetic field that electrons from the electron-emitting cathode must cross to reach the anode. The magnetic-circuit parts include a magnetic-field energizing means of one or more electromagnets or permanent magnets. It also includes magnetically permeable parts that have a magnetic permeability that is significantly greater than that of free space, preferably greater than one or two orders of magnitude greater than that of free space. The preferred permanent magnet material would be one of the Alnico alloys, which would have a substantial advantage in maximum temperature compared to rare-earth permanent-magnet materials. It should be noted that the magnetic-circuit parts, plug body 14, outer shell 15, outer pole piece 16, and permanent magnet 55, constitute the largest and heaviest parts of the ion source. The magnetic circuit also accounts for a major fraction of the cost.

The need for maintenance can result from the limited lifetime of some parts, usually the cathode and the reflector. Maintenance can also result from insulative coatings on anode 17. Such coatings can result from the formation of compounds with the working gas (e.g., the formation of oxides or nitrides with oxygen or nitrogen as the working gas). Such coatings can also result from the external sources, such as when an ion source is used in an ion-assist function with the thermal deposition of a dielectric coating.

Conductive coatings can be deposited on insulators 43 due to internal sputtering in the ion source from normal operation (from reflector 49 or outer pole piece 16). Conductive coatings can also be deposited from occasional arcs that propagate though gap 64 between the anode and main support plate 42 to reach volume 66 external to the anode. As is known to those skilled in the art, the proper use of shadow shielding can reduce the rate at which sputtered coatings are deposited on insulators 43 exposed to volume 66, but it cannot completely eliminate such coatings.

Conductive coatings can also be deposited due to the decomposition of some ionizable working gases, e.g. methane. Such coatings can be found on insulators exposed to the working gas, even if there is no exposure to either the discharge or arcs propagated outside of the discharge region, e.g., volumes 67. Because the decomposition rate tends to increase with increasing temperature, however, these coatings would be more likely on insulators in physical contact with warmer main support plate 42, rather than cooler plug body 14.

The deposition of conductive coatings on parts others than the insulators can eventually be a problem because of the possible shorting due to loosened flakes of deposited layers. As described in the Background Art section, the deposited layers can also come off as particulates that adversely affect the thin-film products of the industrial process.

Disassembly for maintenance of ion-source assembly 11 starts with the removal of retainer nuts 19 from threaded retainer rods 20. The anode, together with the external anode support, can be removed for cleaning by removing screws 47. Removal of screws 48 and 50 then permit removal of internal anode support 46 and reflector 49. To complete the maintenance, it is often necessary to replace all insulators 43 above main support plate 42, as well as remove deposited films on all metal parts in the same region. If conducting deposits can come from the working gas, almost all insulators in the entire ion-source assembly may need to be replaced, as well as almost all metal parts cleaned.

In addition to the extensive disassembly and maintenance procedures required for the prior-art ion source of FIGS. 1 through 4, there is also the reduced utilization of the working gas that is inherent to the design. The working gas can escape the discharge region through gap 64. From there the gas can escape through penetrations in external anode support 18 for threaded retainer rods 20 and cathode support rods 41, as well as through the gap between the external anode support and outer shell 15. Because of the large diameter of the outer shell compared to the diameter of the other parts in the ion-source assembly, the circumferential leakage area between the external anode support and the outer shell can be substantial. Better containment of the working gas would reduce both the loss of this gas, which results in a greater vacuum pumping requirement, and the deposition of conducting films on insulators when decomposition of the working gas is possible.

DESCRIPTION OF PREFERRED EMBODIMENT

Figure 5:
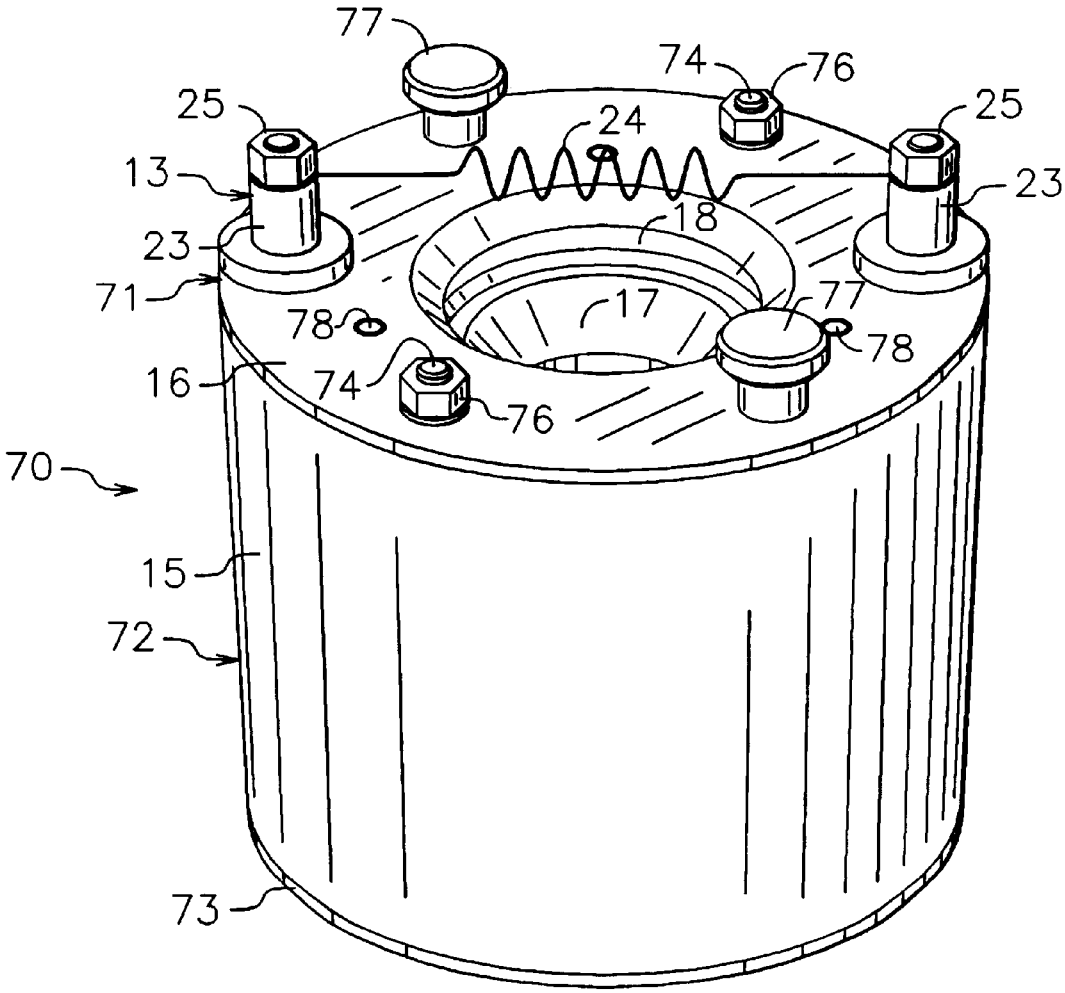
FIG. 5 is an embodiment of the present invention wherein the gridless ion source is of the end-Hall type.

Referring to FIG. 5, there is shown a gridless ion source 70 of the end-Hall type that is an embodiment of the present invention. Ion source 70 is also generally of the type described in U.S. Pat. No. 4,862,032—Kaufman, et al., although it additionally incorporates a detachable anode module that facilitates rapid and economical maintenance.

Ion source 70 includes cathode assembly 13, detachable anode module 71, and magnetic-circuit module 72. Cathode assembly 13 includes cathode supports 23, cathode 24, and cathode retaining nuts 25. The components shown in FIG. 5 for the magnetic-circuit module include outer shell 15 and back plate 73, both of which are also parts of the magnetic circuit. Also parts of the magnetic-circuit module are threaded retainer rods 74.

Retaining nuts 76 are used to clamp anode module 71 to magnetic-circuit module 72. Outer pole piece 16 is part of the anode module and also part of the magnetic circuit. Because outer shell 15 remains with the magnetic-circuit module 72, knobs 77 are attached to outer pole piece 16 to facilitate removal of the anode module from the magnetic-circuit module when the latter is installed in a vacuum chamber. Anode 17, external anode support 18, and enclosure retainer screws 78 are also included in the anode module. To separate the cathode assembly from the rest of ion source 70, the two cathode supports are grasped with the fingers of two hands and lifted, overcoming the friction with which the cathode supports are attached to the rest of the ion source.

Figure 6:
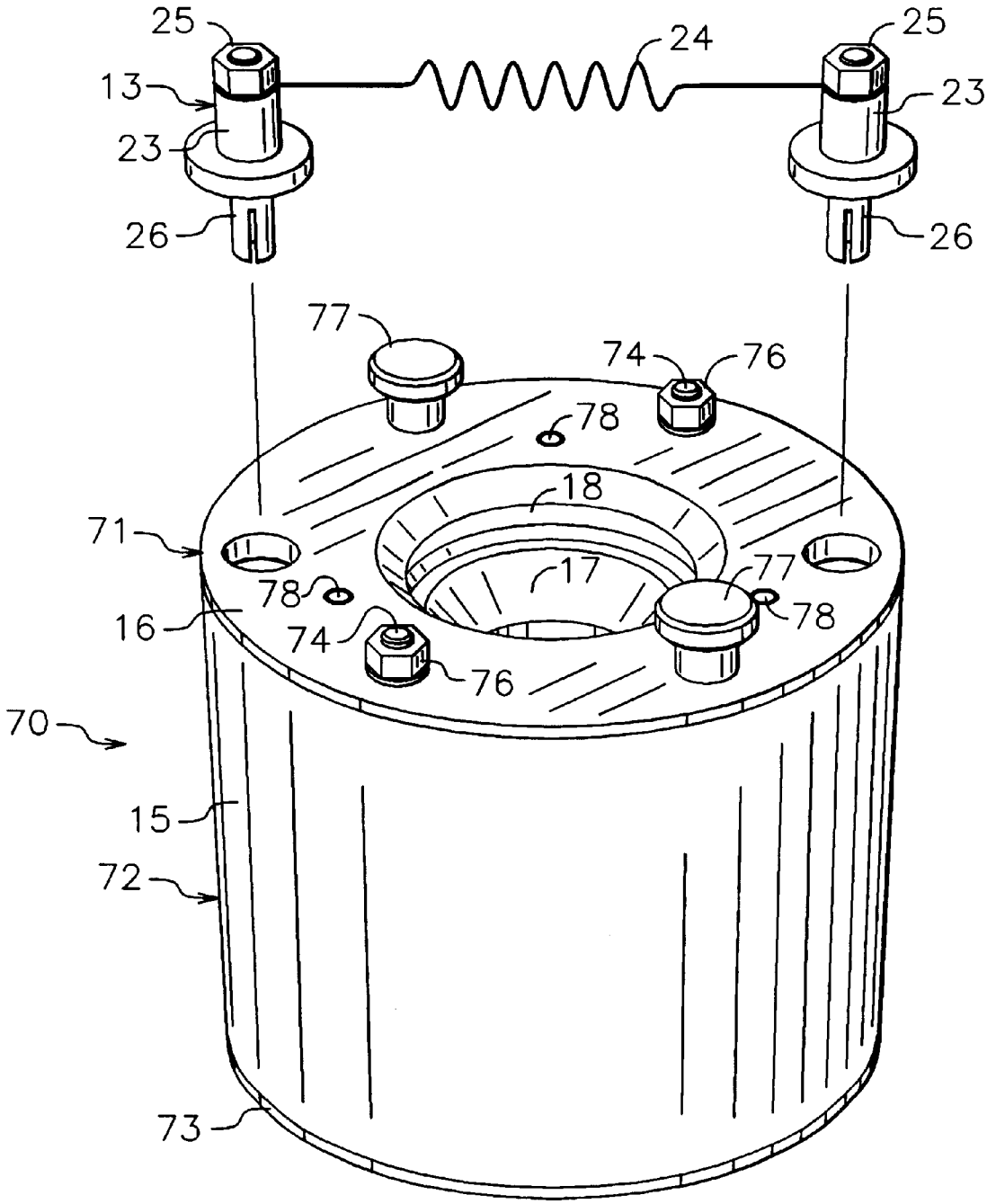
FIG. 6 shows the ion source of FIG. 5 with the hot-filament cathode assembly separated from the rest of the ion source.

Referring to FIG. 6, ion source 70 is shown with cathode assembly 13 separated from the rest of the ion source. At the separated location, the lower ends of cathode supports 23 are exposed to show connectors 26 thereon, with each connector again comprised of elastic spring "fingers" to establish an electrical connection with a cylindrical contact. To separate anode module 71 from magnetic-circuit module 72, retaining nuts 76 are removed and the anode module lifted using knobs 77.

Figure 7:
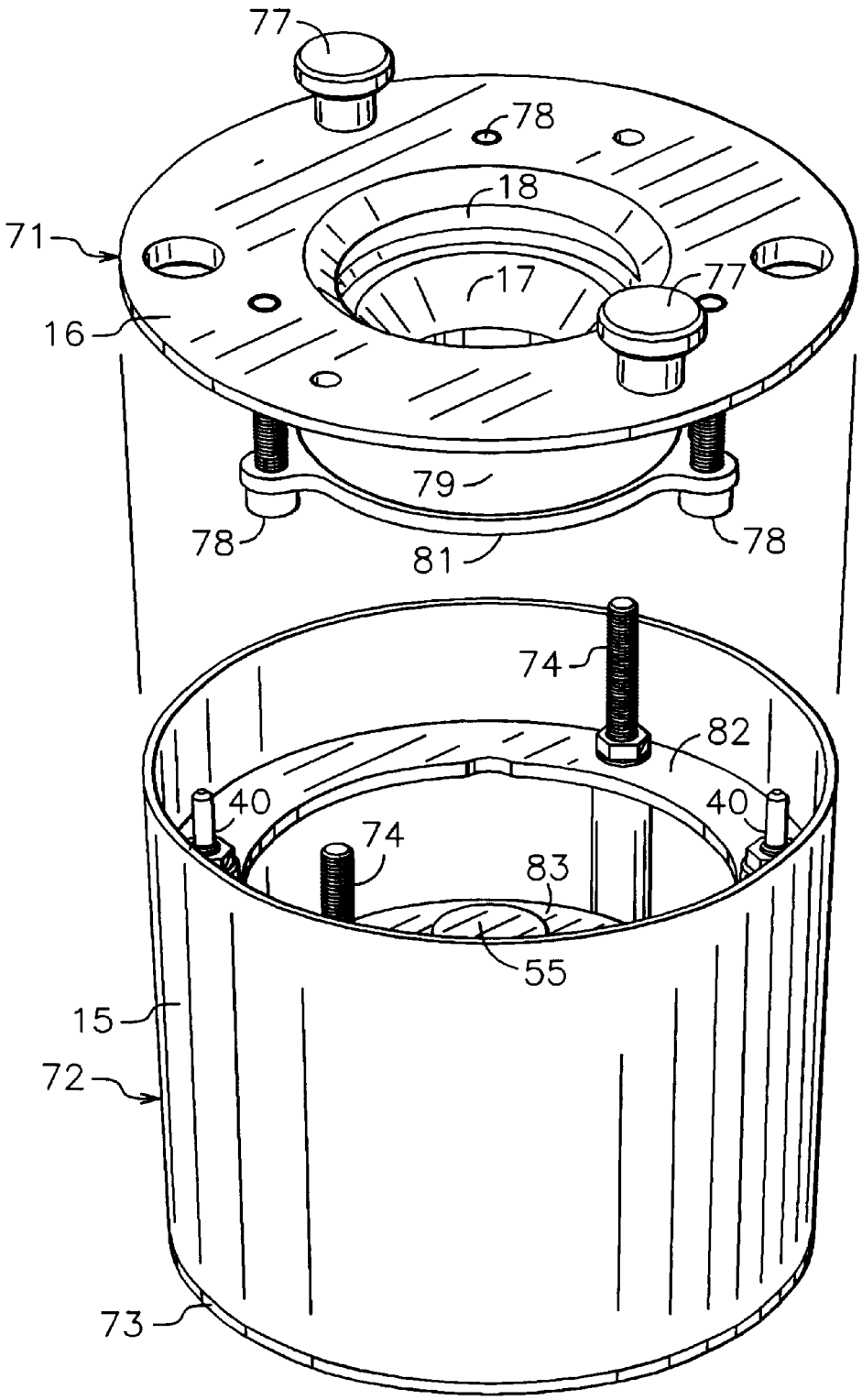
FIG. 7 shows the ion source of FIGS. 5 and 6, without the hot-filament cathode assembly, but with the detachable anode module separated from the magnetic-circuit module.

Referring to FIG. 7, there is shown the detachable anode module separated from the magnetic-circuit module. Additional parts shown for anode module 71 are enclosure wall 79 and enclosure internal end 81. Note that the enclosure is closed on the internal end and open on the external end. Additional parts shown for the magnetic-circuit module are magnet 55, large support ring 82, and small support ring 83.

Figure 8A:
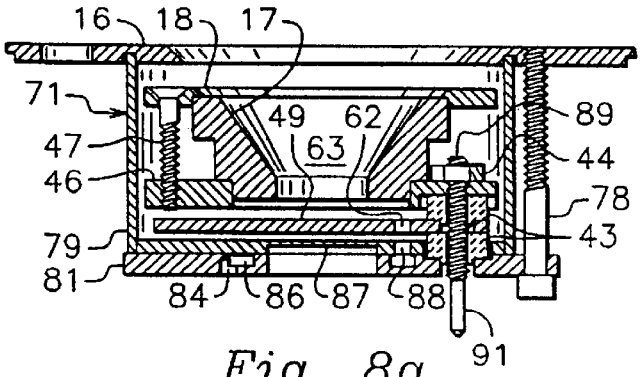
FIG. 8*a* shows a cross section of the detachable anode module of the ion source of FIGS. 5, 6, and 7.

Referring to FIG. 8*a*, there is shown a cross section of anode module 71 of ion source 70. Note that the cross section of FIG. 8*a* is again not a particular cross section of the ion source, but instead is one that has been constructed to include the major design features of that ion source. Parts not shown in FIG. 7, but shown in FIG. 8 include internal anode support 46, screws 47 for holding the internal and external anode supports together, and reflector 49. The reflector again has apertures 62 therein. Enclosure internal end 81 has aperture 84 for introducing the ionizable gas into the enclosure formed by enclosure wall 79 and enclosure internal end 81. The gas flows from aperture 84 to circumferential manifold 86. The circumferential manifold has cover 87 with apertures 88 therein to circumferentially distribute the gas to apertures 62 in reflector 49, from which the gas flows to discharge volume 63. Anode rod 89 electrically connects with anode 17, while being spaced from and located relative to reflector 49 and enclosure internal end 81 by ceramic insulators 43. The lower end of anode rod 89 forms anode cylindrical contact 91.

Figure 8B:
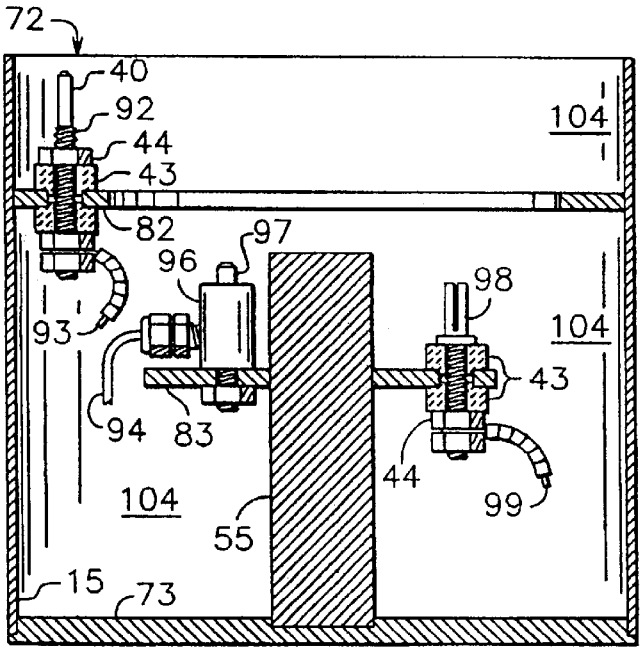
FIG. 8*b* shows a cross section of the magnetic-circuit module of the ion source of FIGS. 5, 6, and 7.

Referring to FIG. 8*b*, there is shown a cross section of magnetic-circuit module 72 of ion source 70. Cathode contacts 40 are integral parts of cathode support rods 92, which are spaced from and located relative to large support ring 82 by additional insulators 43 held in place by nuts 44. Electrical connections of the cathode contacts with the cathode power supply (not shown) are provided by conducting wires covered with ceramic insulator beads 93. The ionizable working gas is provided through tube 94, which connects to gas fixture 96 with nozzle 97. Anode connector 98 is connected to the anode supply (not shown) through conducting wire covered with ceramic insulating beads 99. The anode connector is spaced from and located relative to small support ring 83 by additional insulators 43 held in place with nut 44. When the anode module is clamped to the magnetic-circuit module, nozzle 97 fits closely into aperture 84, so that essentially all of the working gas flows into the enclosure formed by enclosure wall 79 and enclosure internal end 81. In addition, anode contact 91 is inserted into complementary anode connector 98 to electrically connect anode 17 to the anode power supply.

Figure 9A:
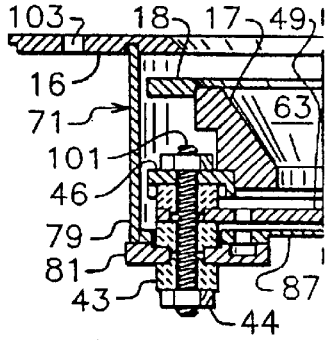
FIG. 9*a* shows a partial cross section of the detachable anode module of the ion source of FIGS. 5, 6, and 7, showing additional features not shown in FIG. 8*a;*

Referring to FIG. 9*a*, there is shown an additional partial cross section of anode module 71 of ion source 70. Internal anode support 46 and reflector 49 are shown to be spaced from and located relative to enclosure internal end 81 by screws 101 and additional insulators 43 held in place by additional nuts 44. There is typically a plurality of screw/insulator/nut assemblies as shown in FIG. 9*a* and only one anode-rod/insulator assembly as shown in FIG. 8*a*, so that the clamping function of a nut is not required on the bottom of anode rod 89 in FIG. 8*a*.

Figure 9B:
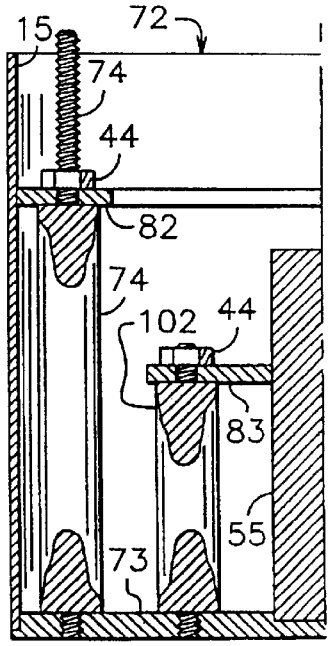
FIG. 9*b* shows a partial cross section of the magnetic-circuit module of the ion source of FIGS. 5, 6, and 7 showing additional features not shown in FIG. 8*b;*

Referring to FIG. 9*b*, there is shown an additional partial cross section of magnetic-circuit module 72 of ion source 70. Threaded retainer rod 74 is screwed into back plate 73, while locating large support ring 82 relative thereto. Small support ring 83 is located relative to back plate 73 by small ring support 102. When the anode module is inserted to the magnetic-circuit module, the ends of threaded retainer rods 74 fit though apertures 103 in outer pole piece 16, so that nuts 76 (shown in FIGS. 5 and 6) on the ends of the threaded retainer rods can clamp the two modules together.

It should be apparent to one skilled in the art of ion-source design that there are many arbitrary design features in the embodiment shown in FIGS. 5 through 9*b*. Cylindrical contacts and complementary connectors are used to make detachable electrical connections. The locations of these contacts and connectors can generally be exchanged, while still performing as a detachable electrical connection. Or a spring contact and a flat surface may be used instead to make a detachable electrical connection. The locations of a nozzle and an aperture for a detachable gas connection may, in a similar manner, be exchanged, while still performing as such a connection. Alternatively, two flat surfaces with matching apertures may be pressed together to perform as a detachable gas connection. The magnetically energizing means is shown as a permanent magnet, but could have been an electromagnet. The magnetically energizing means could also have been a series of permanent magnets used in place of the outer shell, with the central permanent magnet replaced by a simple magnetically permeable path.

To review the maintenance advantages of the apparatus shown in FIGS. 5 through 9*b*, the enclosure formed by enclosure wall 79 and enclosure internal end 81 contains both the electrons and ions that constitute the discharge plasma formed during operation. (Additional discussion of the constituents and properties of this discharge plasma can be found in the aforementioned U.S. Pat. No. 4,862,032—Kaufman, et al.) As is known to those skilled in the art of operating gridless ion sources in general and end-Hall ion sources in particular, sputtered particles are generated from parts exposed to the discharge and tend to flow outward in all directions from the sputtered surfaces of these parts. The enclosure contains these sputtered particles, The insulators and other parts that are in region 104, external to the enclosure but within the magnetic-circuit module when the two modules are clamped together, are thus protected from these sputtered particles. As is also known to those skilled in the plasma-physics art, the containment of the plasma electrons and ions by the enclosure greatly reduces the initiation of discharges and arcs in regions 104, further reducing the deposits on insulators and other parts in regions 104. Finally, if conductive deposits can result from the decomposition of the ionizable working gas, the containment of this gas within the enclosure also reduces the deposits in regions 104. In summary the use of an enclosure surrounding the anode and discharge region limits the required maintenance to essentially the insulators and other parts in the anode module.

Compared to carrying out maintenance on the entire ion source, as required in the prior art, the use of modular construction with a removable anode module permits the maintenance to be carried out on the smaller and lighter anode module. In the event that downtime is to be reduced by purchasing a spare unit, only the less expensive anode module need be purchased. The use of modular construction also facilitates maintenance on parts less frequently replaced, e.g., ready access to the magnet in the preferred embodiment compared to essentially complete disassembly to reach the magnet in the prior art. The use of the invention described above thus results in the general advantage of more rapid and economical maintenance.

In addition to the maintenance advantages, the modular design of the invention reduces the loss of working gas compared to the prior art. In the prior-art design shown in FIGS. 1 through 4, there is gas leakage between outer shell 15 and external anode support 18, as well as leakage through the penetrations through the external anode support 18 for the cathode connections, the plug-and-socket retaining rods, and the threaded retainer rods that hold the ion-source assembly together. In the embodiment of this invention shown in FIGS. 5 through 9*b*, the smaller mean diameter of the gap between the enclosure wall and the external anode support reduces the circumferential leakage area, and there are no penetrations of the external anode support to add to this leakage.

Comparing the invention to the prior art of FIG. 4, openings for the attachment of the cathode assembly in outer pole piece 16 are in the same enclosure formed by the parts of the magnetic circuit and therefore provide additional escape paths for the ionizable working gas. The use of a separate enclosure around the anode (enclosure wall 79 and enclosure internal end 81) thus provides improved containment of the working gas.

ALTERNATE EMBODIMENTS

Figure 10A:
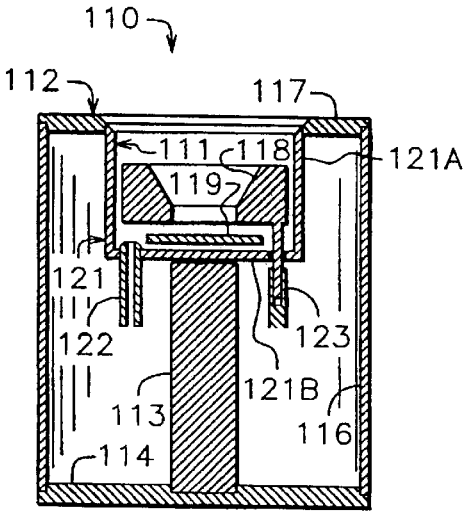
FIG. 10*a* is a simplified cross section of another embodiment of the present invention wherein the gridless ion source is also of the end-Hall type.

A simplified cross section of an alternate embodiment of the present invention wherein the gridless ion source is also of the end-Hall type is shown in FIG. 10*a*. The simplification is in the omission of the screws, nuts, insulators and other common parts that are required for most ion source hardware, but well understood by those skilled in the design art. For example, there are insulators, screws, and internal and external anode supports used to space the anode from the rest of the anode module, while locating it relative to that module—see FIG. 9*a*. As another example, insulators and screws are used to space the reflector from the rest of the anode module, while locating it relative to that module. In a similar manner, the cathode is not shown in FIG. 10*a*. Ion source 110 in FIG. 10*a* is again generally of the type described in U.S. Pat. No. 4,862,032—Kaufman, et al.

Ion source 110 is comprised of anode module 111 and magnetic-circuit module 112. The magnetic circuit is made up of permanent magnet 113, back plate 114, outer shell 116, and outer pole piece 117, all of which are in the magnetic-circuit module. Anode 118, reflector 119, and enclosure 121 are all in the anode module. Enclosure 121 is in turn comprised of enclosure wall 121A and enclosure internal end 121B. The external end of the enclosure is again open. Other parts of the magnetic-circuit module are nozzle 122 to inject the working gas into enclosure 121 and anode connector 123 to establish the electrical connection to the anode.

Figure 10B:
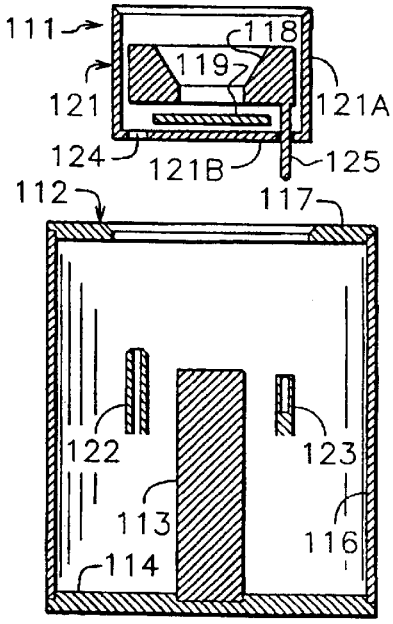
FIG. 10*b* is a simplified cross section of the embodiment shown in FIG. 10*a* wherein the anode module is separated from the magnetic-circuit module.

Referring to FIG. 10*b*, there anode module 111 and magnetic-circuit module 112 are shown separated. Aperture 124 into which nozzle 122 fits and anode contact 125 that electrically connects to complementary anode connector 123 are also shown in FIG. 10*b*.

One difference between the embodiment of FIGS. 5 through 9*b* and that of FIGS. 10*a* and 10*b* is that in the latter the outer pole piece is part of the magnetic-circuit module rather than the anode module. Both embodiments obtain substantial size, weight, and cost benefits from the present invention in that most of the large and heavy magnetic circuit is excluded from the anode module. As shown by the preferred embodiment of FIGS. 5 through 9*b*, though, it is not necessary to exclude all of the magnetic-circuit parts from the anode module.

A related difference between the embodiment of FIGS. 5 through 9*b* and that of FIGS. 10*a* and 10*b* is that in the latter the entire magnetic circuit is external to enclosure 121. As shown by the preferred embodiment of FIGS. 5 through 9*b*, though, it is not necessary that all the magnetic circuit be external to the enclosure.

Figure 11A:
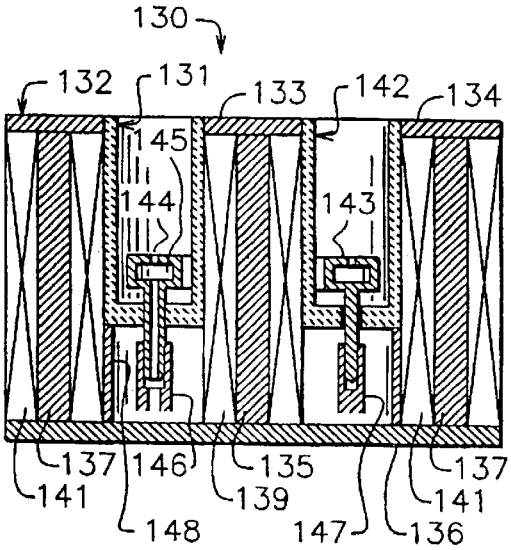
FIG. 11*a* is a simplified cross section of yet another embodiment of the present invention wherein the gridless ion source is of the closed-drift type.

Referring to FIG. 11*a*, there is shown a simplified cross section of an alternate embodiment of the present invention wherein the gridless ion source is of the closed-drift type. Ion source 130 is comprised of anode module 131 and magnetic-circuit module 132.

The magnetic circuit includes inner pole piece 133, outer pole piece 134, inner magnetic path 135, back plate 136, outer permeable paths 137 (typically four), inner magnetically energizing coil 139, and outer magnetically energizing coils 141 (also typically four), all of which are parts of the magnetic-circuit module. Although both permanent magnets and electromagnets have been used in closed-drift ion sources, the use of electromagnets is more common.

Closed-drift gridless ion source 130 is of the magnetic-layer type, which generally uses an insulating ceramic for discharge-chamber wall 142—see the aforementioned article by Zhurin, et. al., in *Plasma Sources Science & Technology*, Vol. 8, beginning on page R1. Anode 143 is of an annular shape with a plurality of apertures 144 for distributing the working gas from internal manifold 145. Anode 143 connects to gas fitting 146 and electrical connector 147. Gas fitting 146 and connector 147 are protected from external contamination by shield 148. A shield enclosing the outside diameter of the magnetic-circuit module would have provided the same protective function, but would also restrict thermal radiation from the outer electromagnets.

Figure 11B:
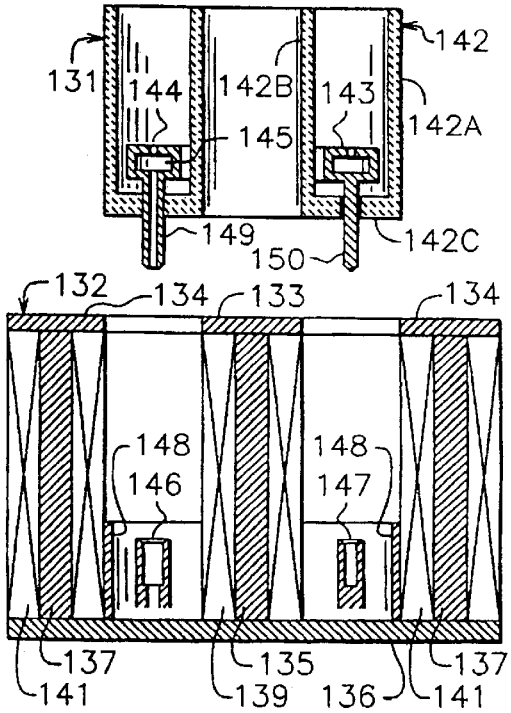
FIG. 11*b* is a simplified cross section of the embodiment shown in FIG. 11*a* wherein the anode module is separated from the magnetic-circuit module.

Referring to FIG. 11*b*, there is shown anode module 131 separated from magnetic-circuit module, thereby exposing gas nozzle 149 and electrical contact 150, with both connected to anode 143.

From the above discussion and FIGS. 11*a* and 11*b*, it should be readily apparent that the present invention can utilize a gridless ion source of the closed-drift type. Note that discharge-chamber wall 142 also serves as an enclosure with outer wall 142A, inner wall 142B, internal end 142*c*, and an open external end.

The embodiments shown all implicitly use axially-symmetric configurations or, in the case of the closed-drift ion source with four outer magnetically permeable paths, near-axially-symmetric configurations. However, other shapes for the discharge region such as elongated or "racetrack" shapes. are well known to those skilled in the art of gridless ion sources. See for example the aforementioned U.S. Pat. No. 4,862,032—Kaufman, et al., or the aforementioned article by Zhurin, et. al., in *Plasma Sources Science & Technology*, Vol. 8, beginning on page R1. The present invention should therefore include embodiments in which the discharge chambers and the ion sources have shapes other than axisymmetric.

While particular embodiments of the present invention have been shown and described, and various alternatives have been suggested, it will be obvious to those of ordinary skill in the art that changes and modifications may be made without departing from the invention in its broadest aspects. Therefore, the aim in the appended claims is to cover all such changes and modifications as fall within the true spirit and scope of that which is patentable.

I claim:

1. A gridless ion-source apparatus comprising:

(a) an electron-emitting cathode means;

(b) anode module means comprising:

(i) an anode;

(ii) enclosure means surrounding said anode, wherein said enclosure means includes wall means, an internal end, and an open external end;

(c) means for introducing an ionizable working gas into said enclosure;

(d) magnetic-circuit module means for generating a magnetic field between said anode and said cathode means;

wherein said anode module means is supported by, and is detachable from, said magnetic-circuit module means.

2. Apparatus in accordance with claim 1, wherein said magnetic-circuit module means comprises one or more permanent magnets.

3. Apparatus in accordance with claim 1, wherein said magnetic-circuit module means comprises one or more electromagnets.

4. Apparatus in accordance with claim 1, wherein said cathode means is detachably supported by said anode module means or said magnetic-circuit module means.

5. Apparatus in accordance with claim 1, wherein said magnetic-circuit module means includes a magnetically permeable outer shell and magnetically permeable back plate.

6. Apparatus in accordance with claim 5, wherein said magnetic-circuit module means further comprises a supply line for said ionizable working gas, and wherein said internal end of said enclosure includes an aperture for receiving said ionizable working gas from said supply line.

7. Apparatus in accordance with claim 5, wherein said magnetic-circuit module means further comprises electrical connection means for providing electrical power to said anode.

8. Apparatus in accordance with claim 7, wherein said anode module means further comprises electrical connection means extending through said internal end of said enclosure means for detachably connecting said anode to said electrical connection means in said magnetic-circuit module means.

9. Apparatus in accordance with claim 6, wherein said magnetic-circuit module means further comprises electrical connection means for providing electrical power to said cathode means.

10. Apparatus in accordance with claim 9, wherein said anode module means further comprises electrical connection means extending through said anode module means for detachably connecting said cathode means to said respective electrical connection means in said magnetic-circuit module means.

11. Apparatus in accordance with claim 1, wherein said gridless ion-source apparatus is of the end-Hall type.

12. Apparatus in accordance with claim 1, wherein said gridless ion-source apparatus is of the closed-drift type.

13. A gridless ion-source apparatus comprising:

(a) an electron-emitting cathode means;

(b) anode module means comprising:

(i) an anode;

(ii) non-magnetic enclosure means surrounding said anode, wherein said enclosure means includes wall means, an internal end, and an open external end;

(c) means for introducing an ionizable working gas into said enclosure;

(d) magnetic-circuit module means for generating a magnetic field between said anode and said cathode means;

wherein said anode module means is supported by, and is detachable from, said magnetic-circuit module means.

14. Apparatus in accordance with claim 13, wherein said magnetic-circuit module means comprises one or more permanent magnets.

15. Apparatus in accordance with claim 13, wherein said magnetic-circuit module means comprises one or more electromagnets.

16. Apparatus in accordance with claim 13, wherein said cathode means is detachably supported by said anode module means or said magnetic-circuit module means.

17. Apparatus in accordance with claim 13, wherein said magnetic-circuit module means includes a magnetically permeable outer shell and magnetically permeable back plate.

18. Apparatus in accordance with claim 17, wherein said magnetic-circuit module means further comprises a supply line for said ionizable working gas, and wherein said internal end of said enclosure includes an aperture for receiving said ionizable working gas from said supply line.

19. Apparatus in accordance with claim 17, wherein said magnetic-circuit module means further comprises electrical connection means for providing electrical power to said anode.

20. Apparatus in accordance with claim 19, wherein said anode module means further comprises electrical connection means extending through said internal end of said enclosure means for detachably connecting said anode to said electrical connection means in said magnetic-circuit module means.

21. Apparatus in accordance with claim 17, wherein said magnetic-circuit module means further comprises electrical connection means for providing electrical power to said cathode means.

22. Apparatus in accordance with claim 21, wherein said anode module means further comprises electrical connection means extending through said anode module means for detachably connecting said cathode means to said respective electrical connection means in said magnetic-circuit module means.

23. Apparatus in accordance with claim 13, wherein said gridless ion-source apparatus is of the end-Hall type.

24. Apparatus in accordance with claim 13, wherein said gridless ion-source apparatus is of the closed-drift type.

* * * * *